United States Patent [19]

Demoures et al.

[11] 4,302,342

[45] Nov. 24, 1981

[54] PROCESS FOR THE PREPARATION OF DETERGENT DISPERSANTS OF HIGH ALKALINITY FOR LUBRICATING OILS AND THE PRODUCT OBTAINED THEREFROM

[75] Inventors: Bernard Demoures, Puteaux; Jean-Louis Le Coent, Le Havre, both of France

[73] Assignee: Orogil, Courbevoie, France

[21] Appl. No.: 50,089

[22] Filed: Jun. 19, 1979

[30] Foreign Application Priority Data

Jun. 26, 1978 [FR] France ..... 78 18945

[51] Int. Cl.[3] ..... C10M 1/40

[52] U.S. Cl. ..... 252/33.2; 252/18; 252/42.7; 252/39; 252/40.7

[58] Field of Search ..... 252/33.18, 33.2, 39, 252/40.7, 42.7

[56] References Cited

U.S. PATENT DOCUMENTS

| | | | |
|---|---|---|---|
| 3,178,368 | 4/1965 | Hanneman | 252/33.4 |
| 4,049,560 | 9/1977 | Dominey | 252/33.2 |
| 4,057,504 | 11/1977 | Shiza et al. | 252/33 |
| 4,148,740 | 4/1979 | Cease et al. | 252/33.2 |

FOREIGN PATENT DOCUMENTS

| | | |
|---|---|---|
| 1080531 | 12/1954 | France . |
| 1015769 | 1/1966 | United Kingdom . |

*Primary Examiner*—Jacqueline V. Howard

*Attorney, Agent, or Firm*—Herbert F. Schwartz; Ronald A. Schapira

[57] ABSTRACT

A process is provided for preparing detergent-dispersant compositions of a TBN of at least about 200, containing at least about 2 percent magnesium, by:

(1) sulfurization by sulfur of an alkylphenol in the presence of a magnesium and/or calcium alkylbenzene-sulfonate of a TBN less than or equal to about 150, an alkaline-earth component selected from among lime, mixtures of magnesium oxide and lime, or a magnesium oxide and alkali hydroxide, and an alkylene glycol;

(2) optionally precarbonation of the resultant mixture by means of $CO_2$;

(3) super-alkalinization and carbonation of the resultant mixture by means of magnesium oxide and possibly lime, $CO_2$ and alkylene glycol; and (4) removal of the excess alkylene glycol.

The detergent-dispersant compositions obtained are useful in the improvement of the detergent-dispersant properties of lubricating oils.

24 Claims, No Drawings

PROCESS FOR THE PREPARATION OF DETERGENT DISPERSANTS OF HIGH ALKALINITY FOR LUBRICATING OILS AND THE PRODUCT OBTAINED THEREFROM

BACKGROUND OF THE INVENTION

The present invention is directed to new detergent-dispersant compositions of high alkalinity for use as additives in lubricating oils and to the preparation of such compositions.

British Pat. No. 1,015,769 discloses the preparation of detergent-dispersants of high alkalinity having a base of alkylphenates and alkylbenzenesulfonates of alkaline-earth metals by sulfurization of a mixture containing an alkylphenol, an alkaline-earth metal alkylbenzenesulfonate, a $C_8$–$C_{18}$ monoalcohol, an alkaline-earth base and glycol, precarbonation of the sulfurized mixture, alkalinization of the precarbonated mixture by an alkaline-earth base, carbonation, and then elimination of the glycol and recovery of the detergent dispersant. This process has the drawback that it requires the use of a $C_8$–$C_{18}$ monoalcohol, which must then be recycled in practically anhydrous form.

Furthermore, while such a prior art process is satisfactory for the preparation of detergent-dispersants containing a high proportion of alkylphenates, it cannot, however, be used for the preparation of detergent-dispersants containing a high proportion of alkylbenzenesulfonates. Moreover, that process is adapted to the preparation of mixtures of alkylphenates and alkylbenzenesulfonates of calcium, barium, or strontium; it cannot be used for the preparation of detergent dispersants containing magnesium.

The present invention provides a process which does not have the drawbacks of the prior art process and which makes it possible to prepare detergent-dispersants having a base of metallic alkylbenzenesulfonates and alkylphenates of a TBN (Total Basic Number—ASTM Standard D 2896) of more than about 200, containing at least about 2 percent magnesium and optionally at least about 0.5 percent calcium.

It is, therefore, an object of the present invention to provide novel detergent-dispersant compositions useful as additives for lubricating oils having a base of alkylbenzene sulfonates and metal alkylphenates.

It is also an object of the present invention to provide a novel process for the preparation of detergent-dispersant compositions for use in lubricating oils.

It is also an object of the present invention to provide lubricating oils containing the novel additives of the invention.

Other objects of the present invention will be apparent to those skilled in the art from the present description.

GENERAL DESCRIPTION OF THE INVENTION

The novel process of preparing the novel detergent-dispersants of the invention employs an alkylphenol, an alkaline-earth metal alkylbenzene sulfonate, an alkylene glycol, sulfur and carbon dioxide, in the following manner:

(1) reacting sulfur, at a temperature of between about 100° C. and 190° C., with an alkylphenol bearing one or more $C_6$–$C_{60}$ alkyl substituents in the presence of a dilution oil, a magnesium and/or calcium alkylbenzenesulfonate of a molecular weight of more than about 300 and a TBN of less than or equal to about 150, an alkaline-earth component selected from among calcium hydroxide, mixtures of magnesium oxide and calcium hydroxide, and mixtures of magnesium oxide and alkaline metal hydroxide, and an alkylene glycol.

(2) superalkalinizing and carbonating the sulfurized medium obtained from step (1) by means of magnesium oxide or a mixture of magnesium oxide and calcium hydroxide, in the presence of an alkylene glycol, at a temperature of between about 100° C. and 250° C., with carbon dioxide;

(3) treating the reaction mixture, at any stage of the superalkalinization/carbonation step (2), above, with 0 to about 10 percent, and preferably 0 to about 5 percent by weight of water, referred to the weight of the said medium at a temperature of 100° C.–150° C.; and (4) removing the excess alkylene glycol and recovering the detergent-dispersant of high alkalinity thus obtained.

The term "magnesium or calcium alkylbenzenesulfonate" is intended to refer to any solution containing about 40 to 95 percent by weight, and preferably 55 to 85 percent by weight, of a magnesium or calcium alkylbenzenesulfonate in a dilution oil, which may or may not be the same as that used to carry out the process of the invention. Among the magnesium and/or calcium alkylbenzenesulfonates which can be used are the magnesium and/or calcium salts of sulfonic acids obtained by sulfonation of alkylbenzenes derived from olefins or polymers of olefins of $C_{15}$–$C_{30}$.

Among the alkylphenols which may be used in the practice of the process of the invention are, preferably, those bearing one or more $C_9$–$C_{15}$ alkyl substituents and, in particular, the nonyl, decyl, dodecyl, and tetradecyl phenols.

Although any type of magnesium oxide can be used, it is preferred, however, to use "active" magnesium oxide. By "active" magnesium oxide is meant magnesium oxide (Mgo) of a specific surface greater than or equal to 80 $m^2/g$., for instance, between 100 and 170 $m^2/g$. As an example, "Maglite DE" of a specific surface close to 140 $m^2/g$. which is marketed by Merck, as well as "Ferumag" of a specific surface close to 160 $m^2/g$. which is marketed by Rhone-Poulenc Industries, may be used.

As an example of alkali metal hydroxides are sodium hydroxide, lithium hydroxide, potassium hydroxide, etc.

Among the dilution oils which may be used, preference is given to the paraffin oils such as 100 Neutral oil, etc.; the naphthene or mixed oils may also be used. The amount of dilution oil which may be used is such that the amount of oil contained in the final product (including that coming from the initial alkylbenzenesulfonate) represents about 20 to 60 percent of said product, and preferably about 25 to 55%.

Among the alkylene glycols which may be used, particular mention may be made of ethylene and propylene glycol; they can possibly be present mixed with up to 200 percent of their weight of a monoalcohol such as ethyl hexanol, tridecyl alcohol, the $C_8$–$C_{14}$ oxo alcohols and, in general, alcohols having a boiling point of more than 120° C., and preferably more than 150° C.

In the preferred practice of the process of the invention:

(1) the sulfurization step is carried out in the presence of a magnesium and/or calcium alkylbenzenesulfonate of a TBN less than or equal to about 50, at a temperature of between about 120° C., and a pressure less than or equal to atmospheric pressure; this step may possibly be followed by an additional step carried out at a higher temperature of between about 130 and 185° C., at a pressure less than or equal to atmospheric pressure in order to complete the sulfurization step;

(2) the superalkalinization/carbonation step is carried out at least once at a temperature of between about 100° C. and 185° C.;

(3) the treatment with water is carried out at a temperature of between about 100° C. and 145° C.

The amounts of reagents which are desirably used in the practice of the process of the invention are as follows:

(1) for the sulfurization step:

(a) from about 10 to 70 parts, and preferably about 15 to 60 parts, of alkylphenol to 100 parts of mixture of alkylphenol and magnesium and/or calcium alkylbenzenesulfonate;

(b) from about 30 to 90 parts, and preferably about 40 to 85 parts, of magnesium and/or calcium alkylbenzenesulfonate for 100 parts of mixture of alkylphenol and alkylbenzenesulfonate;

(c) from about 1.5 to 12 parts, and preferably, about 2.5 to 11 parts, of sulfur for 100 parts of mixture of alkylphenol and alkylbenzenesulfonate;

(d) from about 2 to 30 parts, and preferably about 4 to 20 parts, of alkaline earth component for 100 parts of mixture of alkylphenol and alkylbenzenesulfonate;

(e) up to about 20 parts, and preferably from about 1 to 15 parts, of calcium hydroxide for 100 parts of mixture of alkylphenol and alkylbenzenesulfonate;

(f) up to about 20 parts, and preferably about 2 to 15 parts, of magnesium oxide for 100 parts of mixture of alkylphenol and alkylbenzenesulfonate;

(g) up to about 8 parts, and preferably from 0.05 to 3 parts, of alkali metal hydroxide for 100 parts of mixture of alkylphenol and alkylbenzenesulfonate;

(h) from 5 to about 50 parts, and preferably from about 8 to 30 parts, of alkylene glycol for 100 parts of mixture of alkylphenol and alkylbenzenesulfonate.

(2) for the superalkalizniation/carbonation step:

(a) from about 2 to 15 parts, and preferably from about 3 to 15 parts, of magnesium oxide for 100 parts of sulfurized medium;

(b) up to about 15 parts, and preferably up to about 10 parts, of calcium hydroxide for 100 parts of sulfurized medium;

(c) from about 4 to 100 parts, and preferably from about 7 to 70 parts, of alkylene glycol for 100 parts of sulfurized medium.

The amount of $CO_2$ may vary between the amount which can be completely absorbed and an excess of about 40 percent by weight of said amount. The amount of $CO_2$ will preferably correspond substantially to the amount which can be completely absorbed.

The superalkalinization/carbonation step is preferably carried out in one or two stages.

A variant of the process of the invention involves that prior to the sulfurization/neutralization step, the magnesium and/or calcium alkylbenzenesulfonate is prepared "in situ" by the action of MgO or lime on an alkylbenzene sulfonic acid, as defined above, in the presence of oil, and possibly alkylene glycol, at a temperature of between about 40° C. and 150° C. The amount of MgO, or of lime, and oil to be used is such that the magnesium and/or calcium alkylbenzenesulfonate obtained has a TBN less than or equal to about 150, and preferably less than or equal to about 50.

Another variant of the process of the invention involves carrying out a precarbonation operation after the sulfurization step and before the superalkalinization/carbonation step. This operation can be carried out at a temperature of between about 100° C. and 250° C., and preferably between about 100° C. and 185° C., by means of carbon dioxide. The amount of $Co_2$ which can be used corresponds, within 30 percent plus or minus by weight, to that which can be completely absorbed by the sulfurized medium. This amount of $Co_2$ will preferably correspond substantially to the amount which can be completely absorbed.

At any stage of this operation, a treatment with water can be carried out in addition to or in place of that contemplated in the superalkalinization/carbonation step. This treatment can be carried out under the same conditions as indicated above.

Another object of the present invention is the novel detergent-dispersant compositions of high alkalinity which are obtained by the process of the invention. They have the advantage of excellent compatibility with viscous oils, as well as a very low content of sediment. They can be added to lubricating oils in quantities which are a function of the TBN of the said detergent-dispersant composition and a function of the future use of said oils. Thus, for a gasoline motor oil, the amount of detergent-dispersant of a TBN of between about 200 and 300, for instance, which is to be added, is generally between about 1 and 3.5 percent. In the case of a diesel engine oil, it is generally between about 1.8 and 5 percent, while in the case of a marine engine oil, it may range up to about 25 percent.

The lubricating oils which can thus be improved can be selected from among the most varied lubricating oils, such as the naphthene-base, paraffin-base and mixed base lubricating oils, other hydrocarbon lubricants, for instance, lubricating oils derived from coal products, and synthetic oils, for example, alkylene polymers, polymers of the alkylene oxide type and their derivatives, including polymers of the alkylene oxide type prepared by polymerizing alkylene oxide in the presence of water or alcohols, for instance, ethyl alcohol, dicarboxylic acid esters, liquid esters of phosphorous acids, alkylbenzenes and dialkylbenzenes, polyphenyls, alkylbiphenyl ethers, and polymers of silicon.

Additional additives can also be present in the said lubricating oils together with the detergent-dispersant compositions produced by the process of the invention. These include antioxidant or anticorrosion additives, ash-less dispersant additives, etc.

SPECIFIC DESCRIPTON OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLES 1 to 11

The general method of preparation (five phases) of the superalkalinized detergent-dispersant compositions of Examples 1 to 11 is indicated below and the amounts of reagents necessary for their preparation are set forth in Tables I to III, inclusive, below.

1st phase (sulfurization)

Into a 4-liter, four-neck reactor provided with an agitator and a heating device there are introduced: dodecylphenol (DDP), 100 N oil, an approximately 60 percent solution in 100 N dilution oil of a magnesium alkylbenzenesulfonate (Mg sulfonate) of a molecular weight of about 470 (weight of the sodium salt), said solution containing 1.8 percent magnesium and having a TBN of about 25, and methylpolysiloxane antifoam marketed by Rhone-Poulenc under the designation "SI 200."

The alkaline earth component is then introduced with agitation, selected from among lime, mixtures of "Maglite DE" and lime, or "Maglite DE" and caustic soda and sulfur.

The medium is brought to 145° C., under 260 mm. of mercury pressure, whereupon ethylene glycol is added over 1 hour. The medium is heated to 165° C. and this temperature is maintained for 1 hour under 260 mm. of mercury pressure.

2nd phase (precarbonation)

After having broken the vacuum and heated to 170° C., a precarbonation operation is carried out at 170° C. with the use of carbon dioxide until no further $CO_2$ is absorbed (this phase takes about 1 hour). Cooling is then effected to 100° C. and water is added.

3rd phase (superalkalinization/carbonation)

A mixture of "Maglite DE" and glycol is introduced at 110° C. The carbonation is effected for 4 hours at 110° C.

4th phase (superalkalinization/carbonation)

Water is added. The operation described in the third phase is carried out a second time for 3 hours.

5th phase (separation)

The superalkalinized and carbonation medium of the fourth phase is brought to a temperature of 184° C. at 30 mm. mercury pressure. The glycol distills. The medium is filtered to remove the sediment and there is recovered a solution in 100 N oil of superalkalinized detergent-dispersant, the properties of which are set forth in Tables I(a) to III(a), inclusive, below.

TABLE I

| Examples | 1 | 2 | 3 | 4 |
|---|---|---|---|---|
| 1st phase | | | | |
| DDP in g. | 267 | 339 | 467 | 467 |
| Mg sulfonate in g. | 733 | 929 | 450 | 450 |
| DDP/sulfonate by weight | 27/73 | 27/73 | 51/49 | 51/49 |
| oil in g. | 279 | 353 | 687 | |
| lime in g. | 16 | 20 | 124 | 62 |
| MgO in g. | 60 | 60 | 0 | 44 |
| caustic soda in g. | 0 | 0 | 0 | 0 |
| sulfur in g. | 47 | 59 | 81 | 81 |
| SI 200 in cc. | 1 | 1 | 0.4 | 0.4 |
| glycol in g. | 200 | 250 | 124 | 124 |
| 2nd phase | | | | |
| $CO_2$ in g. | 40 | 50 | 60 | 60 |
| water in g. | 20 | 25 | 25 | 25 |
| weight of precarbonated mixture | 1532 | 1900 | 1902 | 1903 |
| Analysis of the solution | | | | |
| % Mg | 3.1 | 2.9 | 0.4 | 1.1 |
| % Ca | 0.6 | 0.6 | 3.2 | 1.6 |
| % glycol | 9.5 | 10.2 | 4 | 4 |
| % sediments | 1 | 1 | 1 | 1 |
| weight of distillate collected | 60 | 70 | 50 | 50 |

TABLE I(a)

| Examples | 1 | 2 | 3 | 4 |
|---|---|---|---|---|
| 3rd and 4th phases | | | | |
| lime in g. | 0 | 0 | 0 | 2 × 31 |
| MgO in g. | 2 × 30 | 2 × 40 | 2 × 44 | 2 × 22 |
| glycol in g. | 2 × 137.5 | 2 × 150 | 2 × 150 | 2 × 150 |
| $CO_2$ in g. | 2 × 50 | 2 × 50 | 2 × 40 | 2 × 43 |
| water in g. | 20 | 25 | 25 | 25 |
| 5th phase | | | | |
| glycol distilled in g. | 365 | 385 | 220 | 230 |
| % of sediments | 3 | 3 | 2 | 2 |
| weight of detergent-dispersant solution | 1565 | 1961 | 1988 | 1989 |
| Analysis of the solution | | | | |
| % Mg | 5 | 5.3 | 2.2 | 2.2 |
| % Ca | 0.5 | 0.55 | 3.2 | 3.2 |
| TBN | 229 | 233 | 200 | 200 |
| appearance | bright | bright | bright | bright |
| compatibility at 10% in a mineral oil (appearance of the solution) | clear | clear | clear | clear |
| % sediment | 0.08 | 0.09 | 0.02 | 0.03 |

TABLE II

| Examples | 5 | 6 | 7 | 8 |
|---|---|---|---|---|
| 1st phase | | | | |
| DDP in g. | 239 | 479 | 406 | 546 |
| Mg sulfonate in g. | 425 | 449 | 1000 | 588 |
| DDP/sulfonate by weight | 36/64 | 52/48 | 29/71 | 48/52 |
| oil in g. | 465 | 698 | 380 | 501 |
| lime in g. | 63 | 60 | 116 | 130 |
| MgO in g. | 0 | 20 | 0 | 0 |
| caustic soda in g. | 0 | 0 | 0 | 0 |
| sulfur in g. | 39 | 78 | 70 | 94 |
| SI 200 in cc. | 0.9 | 1.3 | 1 | 1 |
| glycol in g. | 60 | 90 | 70 | 130 |
| 2nd phase | | | | |
| $CO_2$ in g. | 40 | 55 | 60 | 65 |
| water in g. | 15 | 20 | 25 | 20 |
| weight of precarbonated mixture | 1300 | 1840 | 2000 | 1950 |
| Analysis of the solution | | | | |
| % Mg | 0.5 | 1 | 1 | 0.5 |
| % Ca | 2.5 | 1.6 | 3.2 | 3.4 |
| % glycol | 3 | 3.5 | 3.2 | 4 |
| % sediments | 1 | 1 | 1 | 1 |
| weight of distillate collected | 20 | 50 | 50 | 70 |

TABLE II(a)

| Examples | 5 | 6 | 7 | 8 |
|---|---|---|---|---|
| 3rd and 4th phases | | | | |
| lime in g. | 0 | 2 × 33.5 | 0 | 0 |
| MgO in g. | 2 × 41.5 | 2 × 34 | 2 × 34.5 | 2 × 58 |
| glycol in g. | 2 × 100 | 2 × 200 | 2 × 65 | 2 × 125 |
| $CO_2$ in g. | 2 × 40 | 2 × 51.5 | 2 × 35 | 2 × 57 |
| water in g. | 15 | 20 | 25 | 20 |
| 5th phase | | | | |
| glycol distilled in g. | 160 | 360 | 100 | 80 |
| % of sediments | 2 | 2 | 2 | 2.5 |
| weight of detergent-dispersant solution | 1400 | 2000 | 2000 | 2000 |
| Analysis of the solution | | | | |
| % Mg | 3.64 | 2.7 | 2.9 | 3.9 |
| % Ca | 2.4 | 3.3 | 3 | 3.2 |
| TBN | 220 | 211 | 200 | 260 |
| appearance | bright | bright | bright | bright |
| compatibility at 10% in a mineral oil (appearance of the solution) | clear | clear | clear | clear |
| % sediments | 0.06 | 0.03 | 0.03 | 0.06 |

TABLE III

| Examples | 9 | 10 | 11 |
|---|---|---|---|
| 1st phase | | | |
| DDP in g. | 594 | 504 | 267 |
| Mg sulfonate in g. | 514 | 652 | 733 |
| DDP/sulfonate by weight | 54/46 | 46/54 | 27/73 |
| oil in g. | 556 | 471 | 279 |
| lime in g. | 144 | 116 | 0 |
| MgO in g. | 0 | 0 | 60 |
| caustic soda in g. | 0 | 0 | 1 |
| sulfur in g. | 102 | 88 | 47 |
| SI 200 in cc. | 1 | 1 | 1 |
| glycol in g. | 150 | 120 | 200 |
| 2nd phase | | | |
| $CO_2$ in g. | 70 | 60 | 40 |
| water in g. | 20 | 20 | 20 |
| weight of precarbonated mixture | 1950 | 1920 | 1532 |
| Analysis of the solution | | | |
| % Mg | 0.5 | 0.4 | 3.1 |
| % Ca | 3.7 | 3.3 | 0 |
| % glycol | 4 | 3.6 | 9.5 |
| % sediments | 1 | 1 | 1 |
| weight of distillate collected | 80 | 70 | 60 |

TABLE III(a)

| Examples | 9 | 10 | 11 |
|---|---|---|---|
| 3rd and 4th phases | | | |
| lime in g. | 0 | 0 | 0 |
| MgO in g. | 2 × 50 | 2 × 76 | 2 × 30 |
| glycol in g. | 2 150 | 2 × 150 | 2 × 137.5 |
| $CO_2$ in g. | 2 × 50 | 2 × 75 | 2 × 50 |
| water in g. | 20 | 20 | 20 |
| 5th phase | | | |
| glycol distilled in g. | 260 | 260 | 365 |
| % of sediments | 2.5 | 2.3 | 3 |
| weight of detergent dispersent solution | 2000 | 2000 | 1565 |
| Analysis of the solution | | | |
| % Mg | 3.4 | 4.34 | 5 |
| % Ca | 3.5 | 3.0 | 0 |
| TBN | 240 | 266 | 215 |
| appearance | bright | bright | bright |
| compatability at 10% in a mineral oil (appearance of the solution) | clear | clear | clear |
| % sediments | 0.06 | 0.07 | 0.09 |

EXAMPLE 12

The operation described in Example 3, above, is carried out with a precarbonation step being effected at 140° C. at atmospheric pressure.

The characteristics of the product obtained are similar to those of the product obtained in Example 3.

EXAMPLE 13

The operation described in Example 3 is carried out starting with an 80 percent solution in 100 N oil of a magnesium alkylbenzenesulfonate of a molecular weight of about 470, said solution containing 2.25 percent magnesium and having a TBN of 32.

The amounts of reagents used are set forth in Table IV, below, the characteristics of the product obtained are given in Table IV(a), below.

EXAMPLE 14

The operation described in Example 3 is carried out starting with a 60 percent solution in 100 N oil of a magnesium alkylbenzenesulfonate of a molecular weight of about 470, said solution containing 2.2 percent magnesium and having a TBN of 45.

The amounts of reagents used are set forth in Table IV, below; the characteristics of the product obtained can be noted from Table IV(a), below.

EXAMPLE 15

The operation described in Example 3 is carried out using a 60 percent solution in 100 N oil of a calcium alkylbenzenesulfonate of a molecular weight of about 470, said solution containing 2.7 percent calcium and having a TBN of 25, without addition of water during the precarbonation and carbonation operations.

The amounts of reagents used are set forth in Table IV, below; the characteristics of the product obtained can be noted in Table IV(a), below.

TABLE IV

| Examples | 13 | 14 | 15 |
|---|---|---|---|
| 1st phase | | | |
| DDP in g. | 467 | 467 | 467 |
| Mg or Ca sulfonate in g. | 360 | 450 | 450 |
| DDP/sulfonate by weight | 56/44 | 51/49 | 51/49 |
| oil in g. | 777 | 687 | 687 |
| lime in g. | 124 | 124 | 104 |
| MgO in g. | 0 | 0 | 0 |

TABLE IV-continued

| Examples | 13 | 14 | 15 |
|---|---|---|---|
| caustic soda in g. | 0 | 0 | 0 |
| sulfur in g. | 81 | 81 | 81 |
| SI 200 in cc. | 0.4 | 0.4 | 0.4 |
| glycol in g. | 124 | 124 | 104 |
| 2nd phase | | | |
| $CO_2$ in g. | 60 | 60 | 52 |
| water in g. | 20 | 20 | 0 |
| weight of precarbonated mixture | 1902 | 1902 | 1885 |
| Analysis of the solution | | | |
| % Mg | 0.4 | 0.6 | 0 |
| % Ca | 3.2 | 3.2 | 3.2 |
| % glycol | 4 | 4 | 4 |
| % sediments | 1 | 1 | 1 |
| weight of distillate collected | 50 | 50 | 50 |

TABLE IV(a)

| Examples | 13 | 14 | 15 |
|---|---|---|---|
| 3rd and 4th phases | | | |
| lime in g. | 0 | 0 | 0 |
| MgO in g. | 2 × 44 | 2 × 30 | 2 × 51 |
| glycol in g. | 2 × 150 | 2 × 145 | 2 × 150 |
| $CO_2$ in g. | 2 × 40 | 2 × 41 | 2 × 51 |
| water in g. | 20 | 20 | 0 |
| 5th phase | | | |
| glycol distilled in g. | 220 | 220 | 220 |
| % of sediments | 2 | 2 | 2 |
| weight of detergent-dispersant solution | 1988 | 1988 | 1986 |
| Analysis of the solution | | | |
| % Mg | 2.2 | 2.2 | 2.2 |
| % Ca | 3.2 | 3.2 | 3.2 |
| TBN | 200 | 200 | 200 |
| appearance | bright | bright | bright |
| compatibility at 10% in a mineral oil (appearance of the solution) | clear | clear | clear |
| % sediments | 0.02 | 0.02 | 0.02 |

EXAMPLE 16

The operation described in Example 3 is carried out without adding water during the precarbonation and carbonation operations.

The product obtained has characteristics equivalent to those of the product of Example 3.

EXAMPLES 17 TO 24

The operations described in Examples 1 to 11 are carried out under the same conditions, while eliminating the precarbonation step and with the amounts of reagents appearing in Tables V and V(a), VI and VI(a), below.

The characteristics of the products obtained appear in Tables V(a) and VI(a), below.

TABLE V

| Examples | 17 | 18 | 19 | 20 |
|---|---|---|---|---|
| 1st phase | | | | |
| DDP in g. | 267 | 339 | 467 | 467 |
| Mg sulfonate in g. | 733 | 929 | 450 | 450 |
| DDP/sulfonate by weight | 27/73 | 27/73 | 51/49 | 51/49 |
| oil in g. | 279 | 353 | 687 | 687 |
| lime in g. | 16 | 20 | 124 | 62 |
| MgO in g. | 60 | 60 | 0 | 44 |
| caustic soda in g. | 0 | 0 | 0 | 0 |
| sulfur in g. | 47 | 59 | 81 | 81 |
| SI 200 in cc. | 1 | 1 | 0.4 | 0.4 |
| glycol in g. | 200 | 250 | 124 | 124 |
| weight of sulfurized mixture | 1472 | 1825 | 1818 | 1819 |
| Analysis of the solution | | | | |
| % Mg | 3.2 | 3.0 | 0.4 | 1.1 |
| % Ca | 0.6 | 0.6 | 3.3 | 1.7 |
| % glycol | 9.7 | 10.4 | 4.1 | 4.1 |
| % sediments | 1 | 1 | 1 | 1 |
| weight of distillate collected | 60 | 70 | 50 | 50 |

TABLE V(a)

| Examples | 17 | 18 | 19 | 20 |
|---|---|---|---|---|
| 2nd and 3rd phases | | | | |
| lime in g. | 0 | 0 | 0 | 2 × 31 |
| MgO in g. | 2 × 30 | 2 × 40 | 2 × 44 | 2 × 22 |
| glycol in g. | 2 × 137.5 | 2 × 150 | 2 × 150 | 2 × 150 |
| $CO_2$ in g. | 2 × 70 | 2 × 75 | 2 × 70 | 2 × 73 |
| water in g. | 60 | 70 | 50 | 40 |
| 4th phase | | | | |
| glycol distilled in g. | 365 | 385 | 220 | 230 |
| % sediments | 3 | 3 | 2 | 2 |
| weight of detergent-dispersant solution | 1565 | 1961 | 1988 | 1989 |
| Analysis of the solution | | | | |
| % Mg | 5 | 5.2 | 2.2 | 2.2 |
| % Ca | 0.5 | 0.5 | 3.2 | 3.2 |
| TBN | 229 | 233 | 200 | 200 |
| appearance | bright | bright | bright | bright |
| compatibility at 10% in a mineral oil (appearance of the solution) | clear | clear | clear | clear |
| % sediments | 0.07 | 0.08 | 0.02 | 0.02 |

TABLE VI

| Examples | 21 | 22 | 23 | 24 |
|---|---|---|---|---|
| 1st phase | | | | |
| DDP in g. | 239 | 479 | 406 | 546 |
| Mg sulfonate in g. | 425 | 449 | 1000 | 588 |
| DDP/sulfonate by weight | 36/64 | 52/48 | 29/71 | 48/52 |
| oil in g. | 465 | 698 | 380 | 501 |
| lime in g. | 63 | 60 | 116 | 130 |
| MgO in g. | 0 | 20 | 0 | 0 |
| caustic soda in g. | 0 | 0 | 0 | 0 |
| sulfur in g. | 39 | 78 | 70 | 94 |
| SI 200 in cc. | 0.9 | 1.3 | 1 | 1 |
| glycol in g. | 60 | 90 | 70 | 130 |
| weight of sulfurized mixture | 1245 | 1765 | 1915 | 1865 |
| Analysis of the solution | | | | |
| % Mg | 0.5 | 1 | 1 | 0.5 |
| % Ca | 2.6 | 1.7 | 3.3 | 3.5 |
| % glycol | 3.1 | 3.6 | 3.3 | 4.2 |
| % sediments | 1 | 1 | 1 | 1 |
| weight of distillate collected | 20 | 50 | 50 | 70 |

TABLE VI(a)

| Examples | 21 | 22 | 23 | 24 |
|---|---|---|---|---|
| 2nd and 3rd phases | | | | |
| lime in g. | 0 | 2 × 33.5 | 0 | 0 |
| MgO in g. | 2 × 41.5 | 2 × 34 | 2 × 34.5 | 2 × 58 |
| glycol in g. | 2 × 100 | 2 × 200 | 2 × 65 | 2 × 300 |
| $CO_2$ in g. | 2 × 60 | 2 × 81.5 | 2 × 65 | 2 × 50 |
| water in g. | 60 | 40 | 50 | 70 |
| 4th phase | | | | |
| glycol distilled in g. | 160 | 360 | 100 | 80 |
| % sediments | 2 | 2 | 2 | 2 |
| weight of detergent-dispersant solution | 1400 | 2000 | 2000 | 2000 |
| Analysis of the solution | | | | |
| % Mg | 3.64 | 2.7 | 2.9 | 3.9 |
| % Ca | 2.4 | 3.3 | 3 | 3.2 |
| TBN | 220 | 211 | 200 | 260 |
| appearance | bright | bright | bright | bright |
| compatibility at 10% in a mineral oil (appearance of the solution) | clear | clear | clear | clear |
| % sediments | 0.06 | 0.03 | 0.03 | 0.06 |

EXAMPLES 25 AND 26

The operation described in Example 17 is carried out using a 60 percent solution in 100 N oil of a calcium alkylbenzenesulfonate of a molecular weight of about 470, said solution containing 2.7 percent of calcium and having a TBN of 25, a carbonation step being effected.

The amounts of reagents, as well as the characteristics of the products obtained, are set forth in Tables VII and VII(a), below.

TABLE VII

| | 25 | 26 |
|---|---|---|
| 1st phase | | |
| DDP in g. | 500 | 400 |
| Ca sulfonate in g. | 566 | 726 |
| DDP/sulfonate by weight | 43/57 | 36/64 |
| oil in g. | 450 | 400 |
| lime in g. | 80 | 104 |
| MgO in g. | 9 | 9.3 |
| caustic soda in g. | 0 | 0 |
| sulfur in g. | 101 | 75 |
| SI 200 in cc. | 1 | 1 |
| glycol in g. | 285 | 254 |
| weight of sulfurized mixture | 1851 | 1770 |
| Analysis of the solution | | |
| % Mg | 0.4 | 0.5 |
| % Ca | 3.2 | 3 |
| % glycol | 10 | 10 |
| % sediment | 0.5 | 0.5 |
| weight of distillate collected | 100 | 100 |

TABLE VII(a)

| Examples | 25 | 26 |
|---|---|---|
| 2nd phase | | |
| lime in g. | 0 | 0 |
| MgO in g. | 141 | 92.4 |
| glycol in g. | 1200 | 1010 |
| $CO_2$ in g. | 160 | 100 |
| water in g. | 100 | 60 |
| 3rd phase | | |
| glycol distilled in g. | 1320 | 1106 |
| % sediments | 0.5 | 0.5 |
| weight of detergent-dispersant solution | 2002 | 1930 |
| Analysis of the solution | | |
| % Mg | 4.3 | 2.9 |
| % Ca | 3 | 3 |
| TBN | 260 | 200 |
| appearance | bright | bright |
| compatibility at 10% in a mineral oil (appearance of the solution) | clear | clear |
| % sediments | 0.07 | 0.03 |

EXAMPLES 27 and 28

Preparation of sulfonate "in situ"

Into the 4-liter, four-neck reactor there are introduced an approximately 70 percent solution in dilution oil of a benzene sulfonic acid of a molecular weight of about 470 (weight of the sodium salt) and 100 N oil.

Lime or an equimolar mixture of lime and "Maglite DE" is introduced with agitation; heating is effected at 120° C. for 1 hour at atmospheric pressure.

1st phase (sulfurization)

To the resultant mixture there are added dodecylphenol (DDP), lime, and antifoam "SI 200."

Heating is effected at 145° C. under 260 mm. mercury pressure. The glycol is added during the course of 1 hour, whereupon the temperature is maintained at 165° C. for 1 hour under 200 mm. mercury pressure.

2nd and 3rd phases (superalkalinization/carbonization)

After having cooled the medium to 110° C., "Maglite DE" and glycol are added to the mixture. Carbonation is effected for 1 hour at 110° C. Water is added and carbonation effected a second time for 3 hours at 110° C.

4th phase

The superalkalinized and carbonated medium is brought to a temperature of 184° C. at 30 mm. mercury pressure. The glycol distills and filtration is effected to eliminate the sediment and recover a solution of detergent-dispersants in 100 N oil.

The amounts of the reagents used and the characteristics of the products obtained are set forth in Tables VIII and VIII(*a*), below.

TABLE VIII

| Examples | 27 | 28 |
|---|---|---|
| Preparation of sulfonate | | |

TABLE VIII-continued

| Examples | 27 | 28 |
|---|---|---|
| sulfonic acid in g. | 384 | 384 |
| lime in g. | 33 | 16.5 |
| MgO in g. | 0 | 8.9 |
| oil in g. | 164 | 164 |
| 1st phase | | |
| DDP in g. | 500 | 500 |
| DDP/sulfonate by weight | 43/57 | 43/57 |
| oil in g. | 450 | 450 |
| lime in g. | 80 | 96.5 |
| MgO in g. | 0 | 0 |
| caustic soda in g. | 0 | 0 |
| sulfur in g. | 90 | 90 |
| SI 200 in cc. | 1 | 1 |
| glycol in g. | 285 | 285 |
| weight of sulfurized mixture | 1851 | 1849 |
| Analysis of the solution | | |
| % Mg | 0 | 0.2 |
| % Ca | 3.2 | 3.1 |
| % glycol | 10 | 10 |
| % sediments | 0.5 | 0.5 |
| weight of the distillate collected | 100 | 100 |

TABLE VIII(a)

| | 27 | 28 |
|---|---|---|
| 2nd and 3rd phases | | |
| lime in g. | 0 | 0 |
| MgO in g. | 141 | 132 |
| glycol in g. | 1200 | 1200 |
| $CO_2$ in g. | 60 + 90 | 60 + 90 |
| water in g. | 100 | 100 |
| 4th phase | | |
| glycol distilled in g. | 1385 | 1385 |
| % sediment | 1 | 1 |
| weight of detergent-dispersant solution | 1980 | 1980 |
| Analysis of the solution | | |
| % Mg | 4.3 | 4.3 |
| % Ca | 3 | 3 |
| TBN | 260 | 260 |
| appearance | bright | bright |
| compatibility at 10% mineral oil (appearance of the solution) | in a clear | clear |
| % sediments | 0.08 | 0.08 |

EXAMPLE 29

The operation described in Example 17 is carried out using the same amounts of reagents, but effecting the sulfurization operation first of all at 165° C. for 1 hour at 250 mm. mercury pressure, and then for 2 hours at 185° C. at 700 mm. mercury pressure. The product obtained has characteristics equivalent to those of the product of Example 17.

Sediment Content

The sediment percentages set forth in the foregoing tables were measured in accordance with ASTM Standard D 2273-67 with, however, the following modifications:

speed of rotation of the centrifuge, 6,000 rpm;
relative centrifugal force, 10,000;
the product to be analyzed is diluted to one-quarter in E gasoline (25 cc. of product to be analyzed plus 75 cc. of E gasoline);
time of centrifuging, 10 minutes.

Compatibility

The compatibility tests appearing in the foregoing tables were carried out by addition of 10 percent by weight of test product to an SAE 30 mineral oil, storage of the resultant solution for one month at 20° C. and study of the appearance of the solution as a function of time.

Comparison with commercial products

Test with the additive alone:

The product of Example 7 is added to an SAE 50 oil having a paraffinic tendency so as to obtain a solution containing 125 millimoles of calcium plus magnesium. The solution is stored for 15 days at 20° C.; the solution is found to remain clear.

The same test is carried out with a mixture of:
magnesium alkylbenzenesulfonate of a TBN of 400;
calcium alkylbenzenesulfonate of a TBN of 25;
calcium alkylphenate of a TBN of 150;
in such amount that the solution obtained contains 125 millimoles of calcium plus magnesium.

After 15 days of storage at 20° C., the solution is cloudy and flocculant.

Test with the additive in formulation:

A mixture (A) of additives is prepared containing:
2 percent of a dispersant having a base of polyisobutenyl succinimide;
1.6 millimole of a zinc dithiophosphate; and
2.3 percent of the product of Example 7.

This mixture is maintained for 25 days at 80° C. and then added to an SAE 30 oil so as to have a concentration of 6.6 percent by weight of mixture (A).

The solution is stored for 5 days at 80° C.

The same test is carried out with a mixture (B) formed of:
2 percent of the dispersant having a base of polyisobutenyl succinimide;
1.6 millimole of zinc dithiophosphate; and
2.3 percent of a mixture formed of:
magnesium alkylbenzenesulfonate of a TBN of 400;
calcium alkylbenzenesulfonate of a TBN of 25;
calcium alkylphenate of a TBN of 150;
having a number of millimoles of calcium plus magnesium equivalent to that of the product of Example 7.

It is found that the solution containing mixture (A) is clearer and brighter than that containing mixture (B).

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process of preparing detergent-dispersant compositions containing at least about 2 percent magnesium, from an alkylphenol, an alkaline-earth metal alkylbenzenesulfonate, an alkylene glycol, sulfur, and carbon dioxide, which process comprises:

(1) reacting sulfur at a temperature between about 100° C. and 190° C., with an alkylphenol bearing one or more $C_6$–$C_{60}$ alkyl substituents, in the presence of a dilution oil, a magnesium and/or calcium alkylbenzenesulfonate of a molecular weight of more than about 300 and a TBN of less than or equal to about 150, an alkaline-earth component selected from among calcium hydroxide, mixtures of magnesium oxide, and calcium hydroxide, and an alkali metal hydroxide and an alkylene glycol;

(2) superalkalinizing and carbonating the resultant sulfurized medium with magnesium oxide or a mixture of magnesium oxide and calcium hydroxide, in the presence of an alkylene glycol, at a temperature of between about 100° C. and 250° C., with carbon dioxide;

(3) at any stage of the superalkalinization/carbonation step, treating the reaction medium with 0 to about 10 percent by weight of water, referred to the weight of the said medium, at a temperature between about 100° C. and 150° C.;

(4) removing the excess alkylene glycol and recovering the detergent-dispersant composition of high alkalinity.

2. A process according to claim 1, wherein the alkylphenol employed contains at least one $C_9$–$C_{15}$ alkyl substituent.

3. A process according to claim 2, wherein the alkylphenol is selected from among nonyl, decyl, dodecyl, and tetradecyl phenols.

4. A process according to claim 1, wherein the alkylene glycol is ethylene glycol.

5. A process according to claims 1 or 4, wherein the alkylene glycol is present in mixture with up to about 200 percent of its weight of a monoalcohol of a boiling point of more than 120° C.

6. A process according to claim 5, wherein the said monoalcohol has a boiling point of more than 150° C.

7. A process according to claim 1, wherein the sulfonization step is carried out in the presence of a magnesium and/or calcium alkylbenzenesulfonate of a TBN of less than or equal to about 50, first at a temperature of between about 120° C. and 190° C. and a pressure lower than or equal to atmospheric pressure, and then at a higher temperature of between about 130° C. and 185° C. at a pressure less than or equal to atmospheric pressure.

8. A process according to claims 1 or 2, wherein the alkali metal hydroxide is selected from among sodium hydroxide, lithium hydroxide, and potassium hydroxide.

9. A process according to claim 1, wherein the sulfurization step employs:

(a) from about 10 to 70 parts of alkylphenol for 100 parts of mixture of alkylphenol and magnesium and/or calcium alkylbenzenesulfonate;

(b) from about 30 to 90 parts of magnesium and/or calcium alkylbenzenesulfonate for 100 parts of mixture of alkylphenol and magnesium and/or calcium alkylbenzenesulfonate;

(c) from about 1.5 to 12 parts of sulfur for 100 parts of mixture of alkylphenol and magnesium and/or calcium alkylbenzenesulfonate;

(d) from about 2 to 30 parts of alkaline-earth component for 100 parts of mixture of alkylphenol and magnesium and/or calcium alkylbenzenesulfonate;

(e) up to about 20 parts of calcium hydroxide for 100 parts of mixture of alkylphenol and magnesium and/or calcium alkylbenzenesulfonate;

(f) up to about 20 parts of magnesium oxide for 100 parts of mixture of alkylphenol and magnesium and/or calcium alkylbenzenesulfonate;

(g) up to about 8 parts of alkali metal hydroxide for 100 parts of mixture of alkylphenol and magnesium and/or calcium alkylbenzenesulfonate; and (h) from about 5 to 50 parts of alkylene glycol for 100 parts of mixture of alkylphenol and magnesium and/or calcium alkylbenzenesulfonate.

10. A process according to claim 9, wherein the sulfurization step employs:

(a) from about 15 to 60 parts of alkylphenol for 100 parts of mixture of alkylphenol and magnesium and/or calcium alkylbenzenesulfonate;

(b) from about 40 to 85 parts of magnesium and/or calcium alkylbenzenesulfonate for 100 parts of mixture of alkylphenol and magnesium and/or calcium alkylbenzenesulfonate;

(c) from about 2.5 to 11 parts of sulfur for 100 parts of mixture of alkylphenol and magnesium and/or calcium alkylbenzenesulfonate;

(d) from about 4 to 20 parts of alkaline-earth component for 100 parts of mixture of alkylphenol and magnesium and/or calcium alkylbenzenesulfonate;

(e) from about 1 to 15 parts of calcium hydroxide for 100 parts of mixture of alkylphenol and magnesium and/or calcium alkylbenzenesulfonate;

(f) from about 2 to 15 parts of magnesium oxide for 100 parts of mixture of alkylphenol and magnesium and/or calcium alkylbenzenesulfonate;

(g) from about 0.05 to 3 parts of alkali metal hydroxide for 100 parts of mixture of alkylphenol and magnesium and/or calcium alkylbenzenesulfonate; and (h) from about 8 to 30 parts of alkylene glycol for 100 parts of mixture of alkylphenol and magnesium and/or calcium alkylbenzenesulfonate.

11. A process according to claim 1, wherein the superalkalinization/carbonation step is carried out at least once at a temperature of between about 100° and 185° C., employing:

(a) from about 2 to 15 parts of magnesium oxide for 100 parts of sulfurized mixture;

(b) up to about 15 parts of calcium hydroxide for 100 parts of sulfurized mixture; and (c) from about 4 to 100 parts of alkylene glycol for 100 parts of sulfurized mixture, the amount of $CO_2$ possibly varying between the amount which can be completely absorbed and an excess of 40 percent by weight of said quantity.

12. A process according to claim 11, wherein the superalkalinization/carbonation step is carried out employing:

(a) from about 3 to 15 parts of active magnesium oxide for 100 parts of sulfurized mixture;

(b) up to about 10 parts of calcium hydroxide for 100 parts of sulfurized mixture;

(c) from about 7 to 70 parts of alkylene glycol for 100 parts of sulfurized mixture, the amount of $CO_2$ corresponding substantially to that which can be completely absorbed.

13. A process according to claims 11 or 12, wherein the superalkalinization/carbonation step is carried out in two stages.

14. A process according to any of claims 1, 11, or 12, wherein the treatment with water is carried out at a temperature of between about 100° C. and 145° C. with the use of 0 to about 5 parts by weight of water to 100 parts by weight of reaction medium.

15. A process according to any of claims 1, 7, 9, 10, or 11, wherein a precarbonation step is carried out after the sulfurization step and before the superalkalinization/carbonation step.

16. A process according to claim 15, wherein the said precarbonation step is carried out at a temperature of between about 100° C. and 250° C. by using an amount of $CO_2$ corresponding to within plus or minus 30 percent of that which can be completely absorbed by the sulfurized mixture.

17. A process according to claim 16, wherein the precarbonation step is carried out at a temperature of between about 100° C. and 185° C. and that the amount of $CO_2$ corresponds substantially to the amount which can be completely absorbed.

18. A process according to claim 15, wherein the reaction medium is subjected to a treatment by 0 to about 10 percent by weight of water at any stage of the precarbonation step at a temperature of between 100° C. and 150° C. in addition to, or in place of, the treatment with water in the superalkalinization/carbonation step.

19. A process according to any of claims 1, 7, 9, 10, or 11, wherein the reaction medium is subjected to treatment with 0 to 5 percent by weight of water at a temperature of between about 100° C. and 145° C.

20. A process according to any of claims 1, 7, 9, 10, or 11, wherein the magnesium and/or calcium alkylbenzenesulfonate used is prepared "in situ" prior to the sulfurization step.

21. A detergent-dispersant additive for lubricating oils, obtained by the process defined by any of claims 1 to 4, 7 or 9, 10, 11 or 12.

22. A novel lubricating composition, having desirable detergent and dispersion properties, comprising an oil containing between 1 and 25 percent by weight of a novel lubricant additive according to claim 21.

23. A gasoline engine oil, having desirable detergent and dispersion properties, containing between about 1 and 3.5 percent by weight of a novel lubricant additive according to claim 21.

24. A novel diesel engine oil having desirable detergent and dispersion properties containing between about 1.8 and 5 percent by weight of a novel lubricant additive according to claim 21.

* * * * *

UNITED STATES PATENT AND TRADEMARK OFFICE

CERTIFICATE OF CORRECTION

PATENT NO. : 4,302,342

DATED : November 24, 1981

INVENTOR(S) : Demoures et al.

It is certified that error appears in the above—identified patent and that said Letters Patent is hereby corrected as shown below:

Column 4, lines 9 and 12, replace "$Co_2$" with -- $CO_2$ -- ;

Column 6, line 9, insert -- 687 -- in column 4 of Table I;

Column 7, line 52, replace "2 150" with -- 2 x 150 -- in column 9 of Table III(a);

Column 13, line 38, insert -- in a -- after "10%" in Table VIII(a) and cancel "in a" in column 27 of Table VIII(a).

Signed and Sealed this

Sixth Day of April 1982

[SEAL]

*Attest:*

GERALD J. MOSSINGHOFF

*Attesting Officer* *Commissioner of Patents and Trademarks*